US006067021A

United States Patent [19]

Huber

[11] Patent Number: 6,067,021

[45] **Date of Patent: *May 23, 2000**

[54] APPARATUS FOR HYDRAULICALLY MOVING A VEHICLE PART

[75] Inventor: Gerhard Huber, Frankenhofen, Germany

[73] Assignee: Hoerbiger Hydraulik GmbH, Schongau, Germany

[ * ] Notice: This patent is subject to a terminal disclaimer.

[21] Appl. No.: 09/316,019

[22] Filed: May 21, 1999

[30] Foreign Application Priority Data

May 22, 1998 [AT] Austria ..... 881/98

[51] Int. Cl.[7] ..... G08B 21/00

[52] U.S. Cl. ..... 340/614; 340/626; 296/107; 296/117; 91/494; 91/530

[58] Field of Search ..... 340/614, 626; 296/107, 117; 91/494, 530

[56] References Cited

U.S. PATENT DOCUMENTS

| | | | |
|---|---|---|---|
| 4,533,908 | 8/1985 | Fujikawa | 340/626 |
| 5,110,175 | 5/1992 | Fischback | 296/117 |
| 5,335,926 | 8/1994 | Stolle | 296/117 |
| 5,682,807 | 11/1997 | Mentink | 91/530 |
| 5,760,695 | 2/1998 | Huber | 340/614 |

*Primary Examiner*—Edward Lefkowitz
*Attorney, Agent, or Firm*—Watson Cole Grindle Watson, P.L.L.C.

[57] ABSTRACT

An apparatus for hydraulically operating a rear cover, covering top or the like (1) on a vehicle, with at least one double-acting hydraulic working cylinder (3), which, on the one hand, is connected to the vehicle and, on the other hand, to the covering top, includes working chambers (8, 9) in connection with each one side of a switched pressure source (12) via one check valve (10, 11) each, wherein both of the check valves have an mutually releasing device and each of the working chambers parallel with respect to the check valves is kept via a pre-stress valve (15, 16), which steers into the tank, at a specified pressure level. To realize, in a simple and safe way, a passive wedging protection, in at least one connection line (4, 5) to the working cylinder (3), a line (22) enters the tank (17), in which a proportional pressure valve (23) is inserted which is controlled by the control electronics and is equal to the exact pressure that is necessary for the movement of the covering top (1) or the like.

6 Claims, 2 Drawing Sheets

APPARATUS FOR HYDRAULICALLY MOVING A VEHICLE PART

BACKGROUND OF THE INVENTION

1. Field of the Invention

The invention relates to an arrangement for the hydraulic operation of a rear cover, a covering top or the like on a vehicle, with at least on double-acting hydraulic working cylinder which is connected, on the one hand, to the vehicle and, on the other hand, to the covering top and its working chambers are in connection with each one side of a switched pressure source via one check valve each, wherein both of the check valves have an mutually releasing device and each of the working chambers parallel with respect to the check valves is kept via a pre-stress valve, which steers into the tank, at a specified pressure level.

2. The Prior Art

Arrangements of that type are known and make possible, for example, the automatic operation of vehicle doors, engine hoods, maintenance caps or also of covering tops of trunks or a chamber holding a convertible top. By means of the releasable check valves, it is ensured that, in the case that the operational pressure is turned off or fails, the covering top remains hydraulically blocked in the respective position, in order to switch off uncontrolled movements and thus possibly resulting dangers. The pre-stress valve makes possible the further controlled movement of the covering top in this condition, for example, by hand, to allow for an emergency closure against the force specified by the pre-stress valve.

A disadvantage of the described known arrangement of the mentioned type is, however, the condition that, in the case that an object or a body part of a user is wedged in, the covering top or the like continues to operate until the very high pressure—and thus also very high forces—of the pressure-limiting valve is reached. This can lead to serious injuries or damages. Even in per-se known pressure-monitoring devices in the system for other hydraulic systems, for example, through monitoring of, for example, the change in the number of rotations of the pump or the like, it takes some time until the pressure increase through something being wedged is noticeable as an increase in the pressure at the site of measurement and is then shown as a change in the monitored parameter. During this time interval, an injury or damage could have already occurred.

It is the object of the present invention to improve a known arrangement of the initially mentioned type such that the described disadvantages are avoided and that, especially in a simple and safe manner, a passive wedging protection is realized.

SUMMARY OF THE INVENTION

The problem is solved with an arrangement of the initially mentioned type, according to the invention, in that, in at least one connection line to the working cylinder, a line enters the tank, in which a proportional pressure valve is inserted which is controlled by the control electronics and is equal to the exact pressure that is necessary for the movement of the covering top or the like. The proportional pressure valve is a part in which the pressure until which it blocks or after which it blocks is proportional to the controlled electricity. The electronic control controls now depending on the angle of the cover—which is determined via path-, angle- or tendency receivers, that is, calculated from their signals in the control electronics—the proportional pressure valve with the electricity which corresponds exactly to the required pressure for the opening and/or closing of the covering top or the like. Thus, acting on the cylinder is only the pressure or the force that still just opens or closes the mentioned part of the vehicle; however, there is no excess of force which is the case in conventional systems arranged for the maximally necessary pressure in a large area of the tilting of sliding movement. The corresponding control curve is preferably determined empirically and stored in the control electronic. Thus an optimal passive wedging protection is achieved, wherein also the different pressure courses for the opening and closing—for example, based on the support of the closing movement through the weight of the covering top or the like—can be considered. In so doing, the pressure-limiting valves necessary in conventional operating arrangements can be eliminated.

According to the embodiment of the invention, the proportional pressure valve is arranged as a valve closed without electricity, through which furthermore the desired stopping function of the cylinder during manual operation is guaranteed through both of the pre-stress valves.

Alternatively, the proportional pressure valve can be arranged as an open valve without electricity which allows for a simpler construction.

So that, however, there continues to exist a stopping function in a non-electrical proportional pressure valve in the direction of the retraction of the working cylinder, according to a further characteristic of the invention between the working cylinder and the proportional pressure valve, a pre-stress valve can be inserted. In so doing, the or every other pre-stress valve can be eliminated. If, for the retraction and extension, other pre-stress pressures are to be provided, it can be, however, realized through an additional pre-stress valve in a simpler manner.

So that during automatic operation and stopping of the cover, for example, through the user no additional pressure decrease occurs at the pre-stress valve, a control line runs from the change-over valve or the pressure source to the pre-stress valve in the line via which it can be controlled from the pressure source.

Advantageously, it is provided that a connection of the connectors of the working cylinder are supplied via a switching valve, wherein the line leading to the proportional pressure valve attaches to the switching valve and is alternately connected to the connector of the working cylinder which connector is supplied by the pressure source. In this way, in a constructive and mechanically simple embodiment, not only the retraction but also the extension of the working cylinder can be controlled by means of a simple proportional pressure valve and, in all cases, of a pre-stress valve in the sense of an optimally passive wedging protection. In so doing, the control electronics recognize, through querying of the operational element of the control or the of the already provided sensors, the direction of the movement and choose the correspondingly stored control curve for the proportional pressure valve for its electrical charging.

The invention is explained in further detail by reference to the accompanying drawings.

DETAILED DESCRIPTION OF THE PREFERRED EMBODIMENTS

Figure 1:
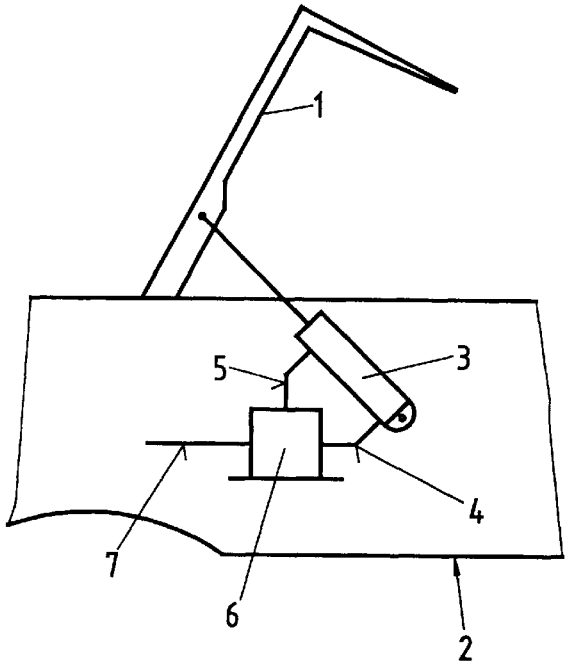
FIG. 1 shows a schematic arrangement in a vehicle according to the present invention.

The arrangement in FIG. 1 for the hydraulic operation of a covering top, a rear cover or any other movable vehicle part 1 on a vehicle 2 has at least one double-acting hydraulic working cylinder which is, one the one hand, connected to the vehicle 2 and, on the other hand, to the covering top 1. The working chambers of the working cylinder which are not further shown here are connected via lines 4, 5 with the hydraulic aggregate 6 which, via a connector line 7 are in connection with the electrical network of the vehicle 2.

Instead of the bilateral direct connection of the working cylinder 3, which naturally requires the corresponding movable lines 4, 5 or a hydraulic aggregate 6 with a working cylinder 3 which moves along with it, the connection of the working cylinder 3 onto the vehicle and/or covering top side could also occur indirectly via levers, hinge arrangements or the like, wherein the working cylinder 3 could also be tightly mounted relative to the vehicle 2.

Figure 2:
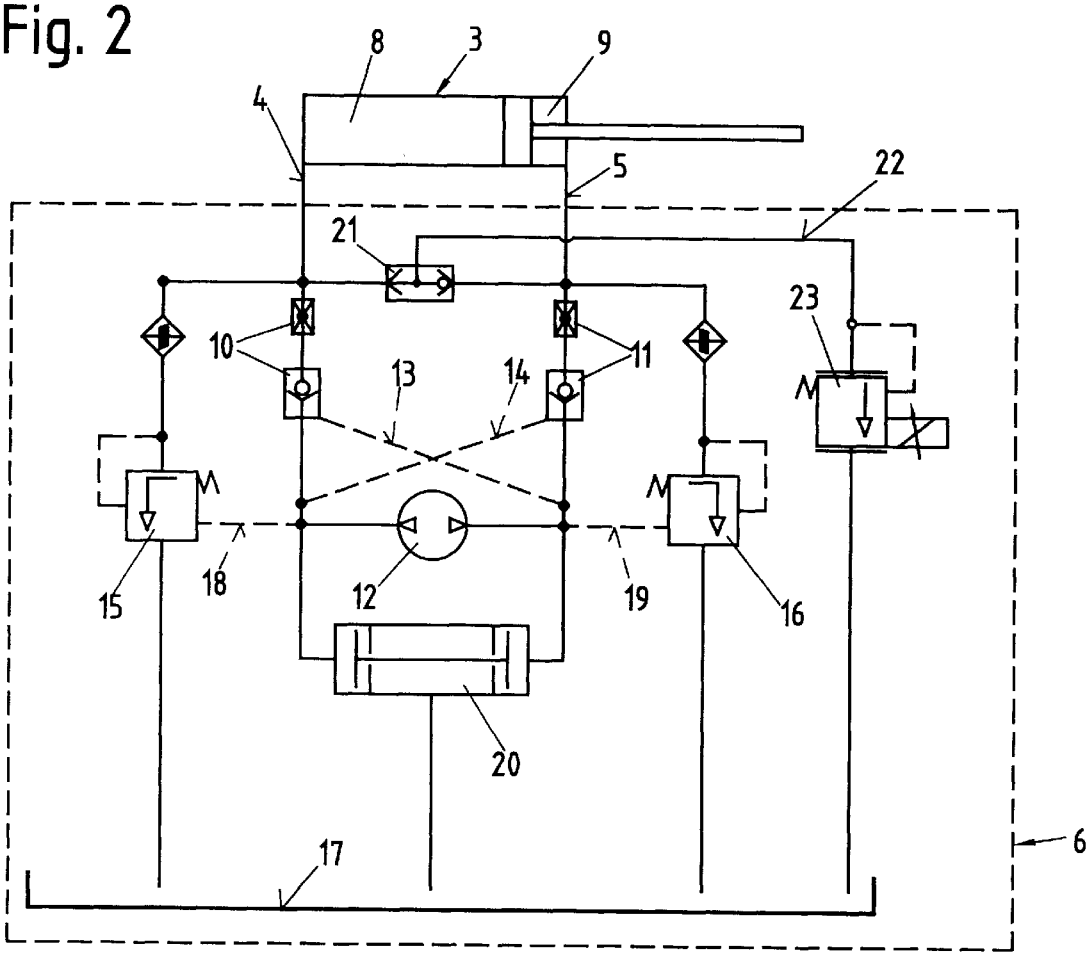
FIG. 2 shows a schematic hydraulic circuit diagram of an innovative arrangement.

In FIG. 2, illustrated in more detail, is a combination of hydraulic aggregate 6 and the working cylinder 3 connected via the lines 4, 5. Both of the working chambers 8, 9 of the working cylinder 3 are in connection, via the lines 4, 5 and each one check valve 10, 11 as arranged in the hydraulic aggregate 6, with one side each of the switchable pressure source 12 (here consisting of a pump and a drive motor). Both of the check valves 10, 11 are connected via lines 13, 14 and can be mutually releasable. Via one pre-stress valve 15, 16 each, both of the working chambers 8, 9 parallel to the check valve 10, 11 are steered off into the tank 17, as soon as a set pressure level is reached or exceeded. The pre-stress valves 15, 16 can be hydraulically blocked off via lines 18, 19 and the pressure prevailing in front of the check valves 10, 11 on the side of the pump.

The connection line 7 which can be seen in FIG. 1, which is not separately illustrated in FIG. 2, controls the motor of the pump of the pressure source 12 and a change-over valve 20 with the lines leading to the tank 17. Furthermore, via this connection line 7, also, for example, limit switches or other position controls could send signals to control units or the like not shown in the figures.

Between the line 4 to the piston-side working chamber 8 of the working cylinder 3 and the line 5 to the rod-side working cylinder 9, a connection line with a switching valve 21 is inserted behind the check valves 10, 11. This switching valve 21 connected alternately line 4 and/or line 5 with a line 22, which is supplied by the pressure source 12 with a pressure medium. Via the line 22, the pressure lead to the working cylinder 3 is also applied to a proportional pressure valve 23. This is arranged in the embodiment example of FIG. 2 as closed without electricity, so that the pre-stress valves 15 and 16 can fulfill their stopping function in an operation arrangement without electricity and can hold the covering top 1 or the like in the respective position.

In the following, the function of the illustrated arrangement as shown in FIG. 2 is explained. In the hydraulic opening or closing, the working cylinder 3 extends or retracts. The motor of the pump of the pressure source 12 is electrically charged, the pump runs and supplies pressure medium via the check valves 10 or 11 into the piston-side working chamber 8 or the rod-side working chamber 9. Via the lines 18 or 19, the pre-stress valve 15 or 16, which lies on the same side as the through-flown check valve, is controlled. The pressure in the working chamber 8 or 9 can increase to the value, at which the proportional pressure valve 23 opens. This pressure is provided by the control curve which located in the control electronics.

A typical control curve will provide a higher electricity at the beginning of the opening movement, so that the extension and overcoming of the beginning resistance can be preformed with a higher force. Also the kinematics and the lever relationships are at the beginning rather advantageous, so that a higher force is necessary. The pressure and the force generated thereby are merely adjusted to one value which is exactly sufficient to conducted or conclude the opening movement in the respective phase. Excess of force which are necessary and, in the case of obstacles in the path of the covering top 1, lead to damages or injuries are avoided. As soon as the covering top is in motion and also the kinematics and the lever relationships are more suitable, the pressure and thus also the operating force is controlled and the proportional pressure valve less electrically charged. At the end of the tilting, the kinematics are usually again less suitable; the influence of the weight of the covering top usually plays just a subordinate role, since it is essentially in a unstable state of equilibrium. The blocking value of the proportional pressure valve for the pressure in the system is therefore rather increased, however, not to a value as high as at the beginning of the movement.

During the closing, in a sense, the same relationships in opposite order are provided, wherein, however, it must be considered that the lowering of the covering top is supported by their weight, so that the pressure level adjusted via the proportional pressure valve must be even lower than in the same position of the opening process.

The covering top 1 (FIG. 1) opens or closes hydraulically until the impact in the working cylinder 3. The volume of the rod-side working chamber 9 flows off during the opening via the check valve 11 hydraulically controlled via the line 14 and via the change-over valve 20 into the tank 16. Depending on the counter weight or the counter force at the covering top 1, the hydraulics supply a total of the force adjusted at the proportional pressure valve 23. The pump runs until the covering top 1 is opened and is then turned off.

Figure 3:
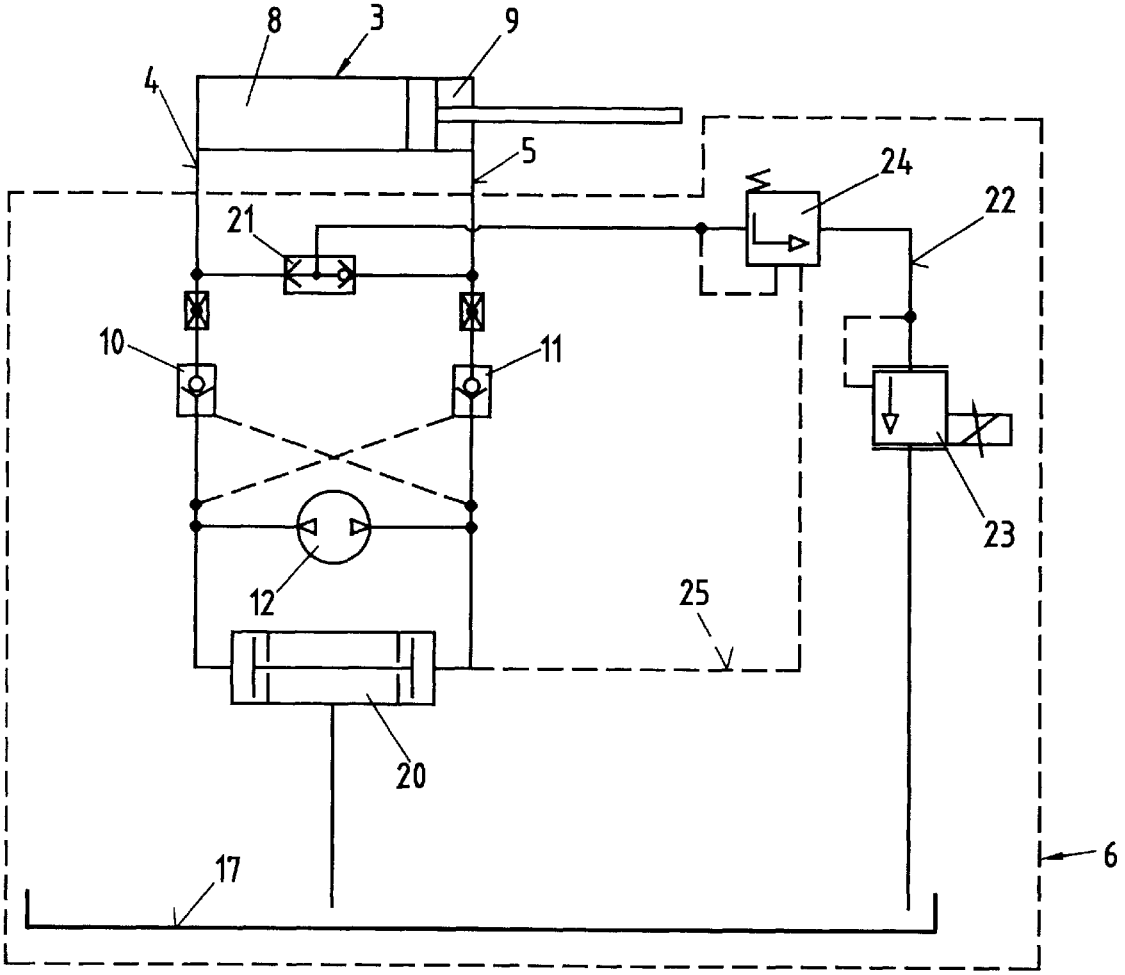
FIG. 3 shows a schematic hydraulic circuit diagram of an alternative version.

In the further embodiment illustrated in FIG. 3, line 22 between the switching valve 21 and the proportional pressure valve 23, which here is arranged as open without electricity, a pre-stress valve 24 is inserted. This pre-stress valve 24 is controlled via a control line 25 from the pressure source 12 or the pressure prevailing on the side of the check valve 11. Thus, it is again guaranteed—with a relatively simple construction of the proportional pressure valve 23—that the covering top 1 or the like is kept in the respective position in an operating arrangement 6 without electricity through the pressure increasing to the pre-set value of the pre-stress valve 24.

Besides the illustrated and described arrangement and operation of a covering top 1 according to FIG. 1 (for example, at a trunk or the engine hood of a motorized vehicle), the arrangement according to the invention could naturally also be used for the operation of rear covers that are vertical in the closed state, for example, of a station wagon or a bus. Other uses would be, for example, vehicle doors, maintenance or ventilation caps and the like.

What is claimed is:

1. Apparatus for hydraulically operating a movable part attached to a vehicle, comprising at least one double-acting hydraulic working cylinder, which is connected between the vehicle and the movable part, wherein working chambers of the working cylinder are connected by connection lines with respective sides of a switched pressure source, said connection lines including respective check valves, wherein both of the check valves have a mutually releasing device and each of the working chambers connected to the respective check valves is maintained at a predetermined pressure level via a pre-stress valve which drains into a tank, and wherein a line which extends to said tank is connected to at least one said connection line, said line including a proportional pressure valve controlled by control electronics and is equal to the exact pressure that is necessary for movement of the movable part.

2. Apparatus according to claim 1, wherein the proportional pressure valve is arranged as a valve closed without electricity.

3. Apparatus according to claim 1, wherein the proportional pressure valve is arranged as a valve opened without electricity.

4. Apparatus according to claim 3, wherein a pre-stress valve is inserted between the working cylinder and the proportional pressure valve.

5. Apparatus according to claim 4, wherein a control line runs in a line from the change-over valve or the pressure source to the pre-stress valve.

6. Apparatus according to claim 1, wherein a connection of the connectors of the working cylinder is provided via a switching valve, wherein the line leading to the proportional pressure valve attaches to the switching valve and is alternately connected to the connector of the working cylinder which connector is supplied by the pressure source.

* * * * *